US005918401A

United States Patent [19]

Rowlands

[11] Patent Number: 5,918,401

[45] Date of Patent: Jul. 6, 1999

[54] BOLT ASSEMBLY COMPRISING EJECTION PORT COVER

[75] Inventor: Kenneth Charles Rowlands, Utica, N.Y.

[73] Assignee: Remington Arms Company, Inc., Madison, N.C.

[21] Appl. No.: 08/968,695

[22] Filed: Nov. 12, 1997

[51] Int. Cl.[6] ..... F41A 3/64; F41A 3/76

[52] U.S. Cl. ..... 42/16; 42/14

[58] Field of Search ..... 42/16

[56] References Cited

U.S. PATENT DOCUMENTS

| | | | |
|---|---|---|---|
| 1,413,109 | 4/1922 | Feederle | 42/16 |
| 1,878,038 | 9/1932 | Frommer | 42/16 |
| 2,288,202 | 6/1942 | Mossberg | 42/16 |
| 2,341,767 | 2/1944 | Gans | 42/25 |
| 3,368,298 | 2/1968 | Browning | 42/16 |
| 3,619,926 | 11/1971 | Alday | 42/16 |
| 3,938,271 | 2/1976 | Hyytinen | 42/16 |
| 4,044,487 | 8/1977 | Hutton et al. | 42/16 |
| 5,718,073 | 2/1998 | Sachse et al. | 42/16 |

FOREIGN PATENT DOCUMENTS

| | | | |
|---|---|---|---|
| NR. 140354 | 1/1935 | Austria | 42/16 |
| 519 | of 1901 | United Kingdom | 42/16 |

*Primary Examiner*—Charles T. Jordan
*Assistant Examiner*—Denise J. Buckley
*Attorney, Agent, or Firm*—Huntley & Associates

[57] ABSTRACT

A firearm having a reciprocating bolt assembly comprising a spring biased ejection port cover operatively connected to the bolt assembly to cover the ejection port when the bolt assembly is in the forward breech closed position, and which moves with the bolt assembly to uncover the ejection port when the bolt assembly is in the rearward breech open position.

14 Claims, 8 Drawing Sheets

BOLT ASSEMBLY COMPRISING EJECTION PORT COVER

BACKGROUND OF THE INVENTION

This invention relates generally to firearms having an ejection port and more particularly to a bolt assembly comprising an ejection port cover for use in such firearms. An ejection port cover acts to uncover and cover the ejection port of the firearm to allow for the ejection of spent cartridges. More specifically, the present invention relates to a firearm having a reciprocating bolt assembly comprising an ejection port cover that is operatively connected to move with the bolt assembly to cover and uncover the ejection port of the firearm.

The purpose of an ejection port cover is to cover the ejection port formed in the receiver of a firearm when spent cartridge ejection is not taking place, thereby preventing dust or other foreign material from entering the closed firearm action. Recently, longer rounds of ammunition have become increasingly popular, especially longer shotshells, which contain more pellets than normal and thus increase the chances for a successful shot. For example, 12 gauge shotshells are presently available in 2.75, 3, and 3.5 inch configurations.

Generally, the need for a firearm having an ejection port large enough to accommodate longer rounds of ammunition was previously filled by firearms having larger receivers. Firearms with larger receivers required a correspondingly larger bolt assembly and ejection port, both of which were adapted for use in the larger receiver. Consequently, there is a need for a firearm of conventional dimensions adapted for use with standard and longer rounds of ammunition, wherein the firearm has a longer ejection port formed in a receiver of conventional dimensions.

SUMMARY OF THE INVENTION

The present invention provides a means for covering the ejection port of a firearm adapted for use with longer rounds of ammunition. Specifically, the present invention provides, in a firearm having a barrel assembly, a trigger assembly, a receiver having an ejection port, a bolt assembly moveable within the receiver between a forward breech closed position and a rearward breech open position, an improved bolt assembly comprising a bolt body, a firing pin, and an ejection port cover biased rearward with respect to the bolt body to cover at least a rearward portion of the ejection port when the bolt assembly is in a forward breech closed position, the ejection port cover operatively connected to the bolt body to move, along a longitudinal axis parallel to the barrel assembly, with the bolt assembly to uncover the ejection port when the bolt assembly is in the rearward breech open position.

The present invention also provides, in a firearm having a barrel assembly, a trigger assembly, a receiver having an ejection port, a bolt assembly moveable within the receiver between a forward breech closed position and a rearward breech open position, an improved bolt assembly comprising a bolt body, a firing pin, a bolt carrier assembly, and an ejection port cover biased rearward with respect to the bolt carrier assembly to cover at least a rearward portion of the ejection port when the bolt carrier assembly and bolt body are in a forward breech closed position, the ejection port cover operatively connected to the bolt carrier assembly to move, along a longitudinal axis parallel to the barrel assembly, with the bolt carrier assembly to uncover the ejection port when the bolt carrier assembly and bolt body are in a rearward breech open position.

DETAILED DESCRIPTION OF THE INVENTION

The present invention will be more fully understood by reference to the drawings, which show one embodiment of the present invention adapted for use in a shotgun. Variations and modifications of this embodiment can be substituted without departing from the principles of the invention, as will be evident to those skilled in the art. Specifically, the present invention can be adapted for use in a shotgun, a rifle, or any firearm having a reciprocating bolt.

Figure 1:
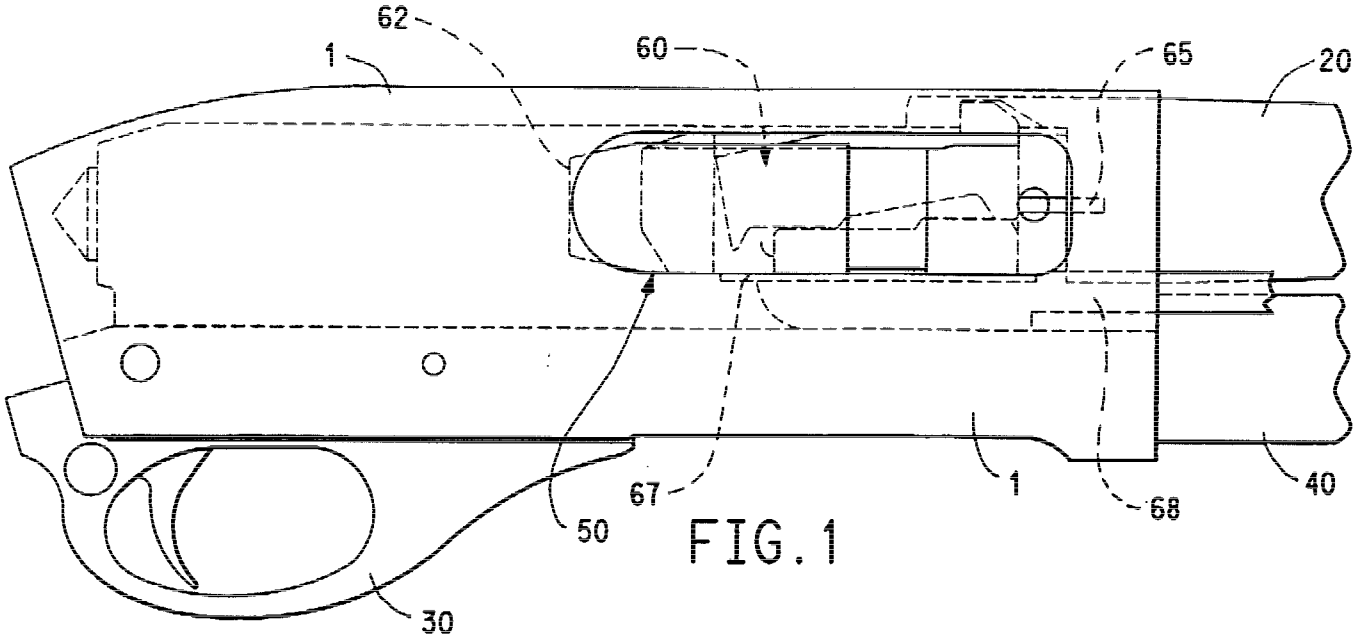
FIG. 1 is a side elevational view of a middle portion of a conventional shotgun comprising an embodiment of the bolt assembly and ejection port cover of the present invention.
Figure 15:
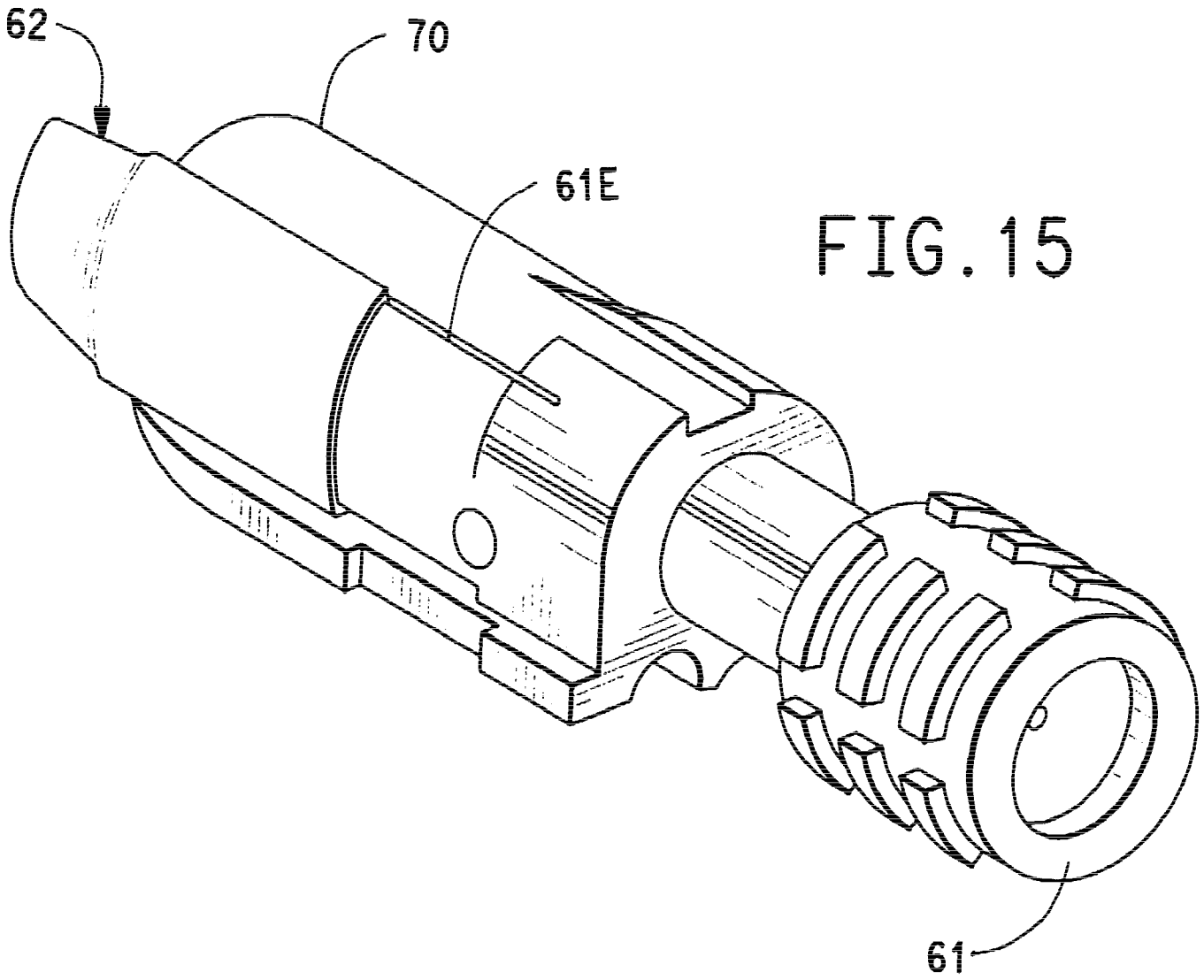
FIG. 15 is a side elevational view of a second embodiment of a bolt assembly and ejection port cover of the present invention.

FIG. 1 shows a portion of a firearm having a bolt assembly and ejection port cover of the present invention. In FIG. 1, the firearm is a shotgun, and thus the embodiment of the bolt assembly and ejection port cover shown is adapted for use in such a firearm. Specifically, the bolt assembly shown slides back and forth within the receiver, between a forward breech closed position shown in FIGS. 1 and 2, and a rearward breech open position shown in FIGS. 3 and 4. Alternate embodiments of the present invention can be used in shotguns having bolt assemblies that rotate while reciprocating between forward and rearward positions, as shown in FIG. 15. For clarity, FIGS. 1–4 show only a middle portion of the firearm, wherein the stock, fore end assembly, and muzzle end of the barrel have been omitted.

Figure 2:
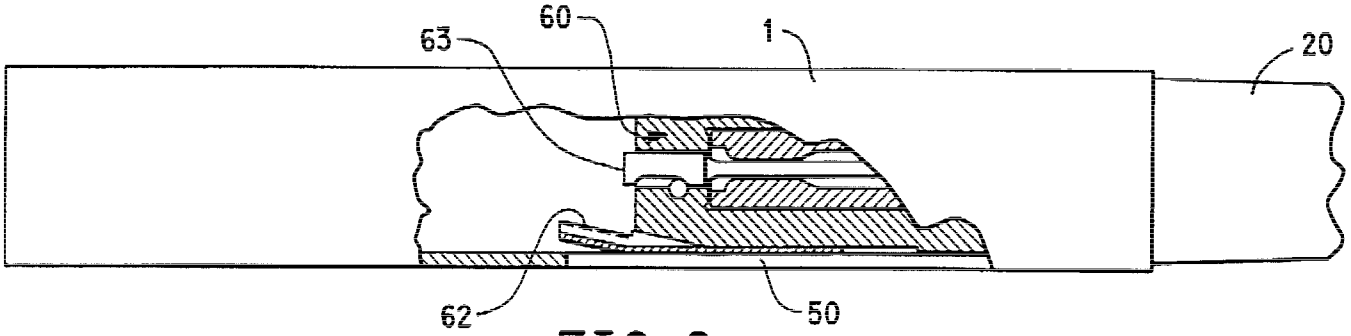
FIG. 2 is a top view of the shotgun of FIG. 1 in which a top portion of the receiver has been partially broken away to show the bolt assembly and ejection port cover in a forward breech closed position.

In FIGS. 1 and 2, the firearm comprises a receiver 1, a trigger assembly 30 at a lower rearward portion of the receiver, and a barrel 20 and magazine tube 40 at a forward end of the receiver. An ejection port 50, formed in a side of the receiver 1, is adapted to permit the ejection of a fired (or unfired) cartridge or shotshell from the receiver. In some firearms, a cartridge or shotshell can be inserted into the chamber through the ejection port, but in the firearm shown, shotshells are manually loaded into the magazine tube and then into the chamber as appropriate.

After a shotshell has been fired from the chamber, the bolt assembly is forced rearward, opening the ejection port. As the bolt assembly moves rearward, the ejection port is opened, exposing the shell, which is urged rearward by an extractor 65 located in the forward end of the bolt assembly. As the shell is being urged by the extractor, it contacts an ejection surface (not shown) on the inside of the receiver and is ejected through the ejection port.

Because the various embodiments of the present invention are adapted for use in firearms having a reciprocating bolt assembly, the figures show one embodiment of the present bolt assembly in a rearward breech open position and a forward breech closed position. As shown in FIGS. 1 and 2, the bolt assembly 60 is in a forward breech closed position, which can also be a ready to fire position, in contrast to the rearward breech open position of the bolt assembly 60 shown in FIGS. 3 and 4. When the bolt assembly is in a forward breech closed position, the ejection port cover 62 extends rearward of the bolt body 61 to close the gap in the ejection port behind the rear of the bolt body 61.

As shown in FIGS. 1–4, the bolt assembly 60 comprises a bolt body 61, an ejection port cover 62, a firing pin 63, a firing pin spring (not shown), and an extractor 65. The bolt assembly further comprises a locking block 66, a slide assembly 67, and action bars 68, which are typical components of the barrel action of a semi-automatic firearm. In the various embodiments of a bolt assembly of the present invention, the firing pin, firing pin spring, extractor, locking block, slide assembly and other components can be conventional, or can vary according to the type of firearm for which the bolt assembly is adapted. These elements, typically central to a firearm, can exist in any form that is compatible with a firearm having a reciprocating bolt assembly. Accordingly, the present invention can be used in firearms having bolt assemblies of many different configurations, provided the bolt assembly comprises an ejection port cover operatively connected to the bolt body within the framework of a bolt assembly.

Figure 3:
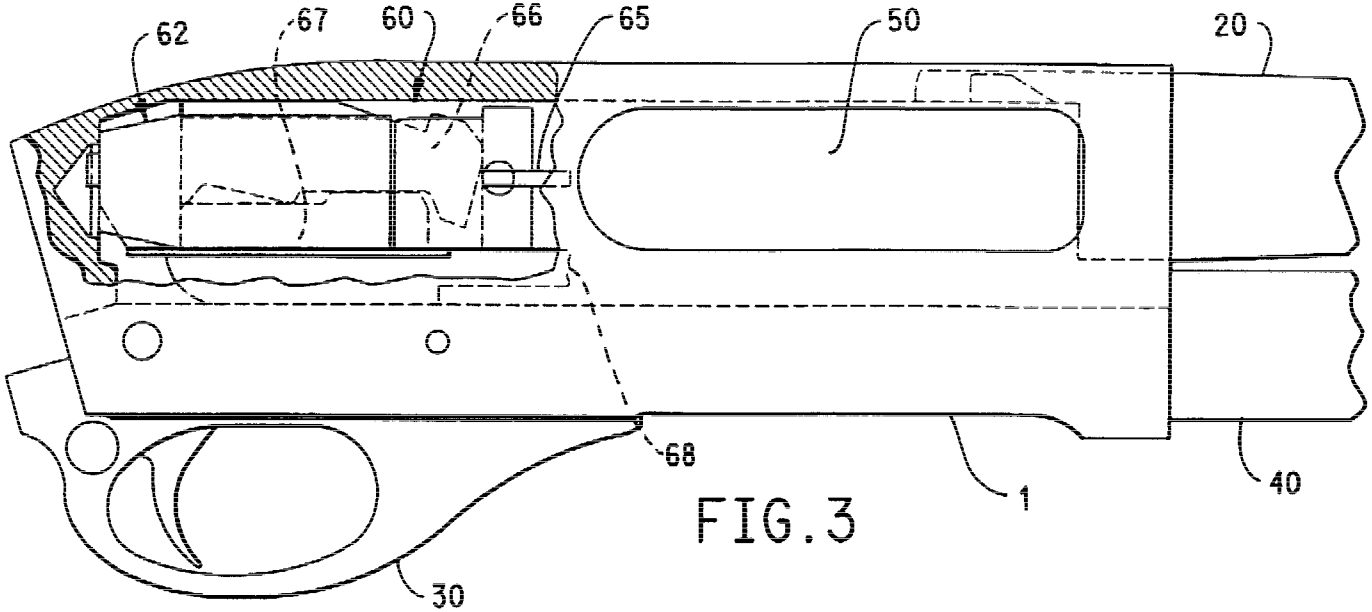
FIG. 3 is a side elevational view of the shotgun of FIG. 1, partially broken away to show the bolt assembly and ejection port cover in a rearward breech open position in which the ejection port cover has been urged forward relative to the bolt, by contact with the rear of the receiver.
Figure 4:
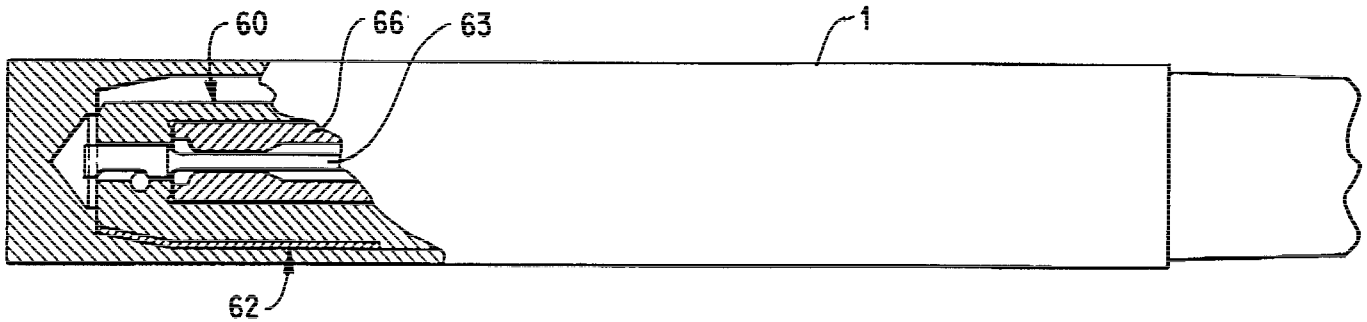
FIG. 4 is a top view of the shotgun of FIG. 1 in which a top portion of the receiver has been partially broken away to show the bolt assembly and ejection port cover in a rearward position.
Figure 5:
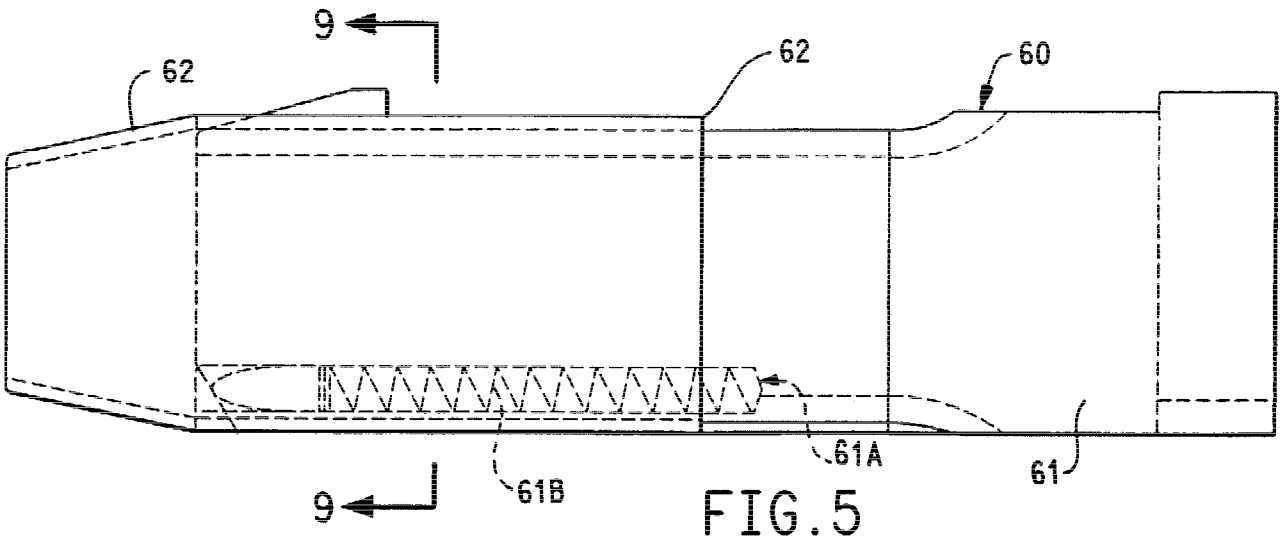
FIG. 5 is a side elevational view of the bolt assembly and cover shown in FIG. 2.
Figure 6:
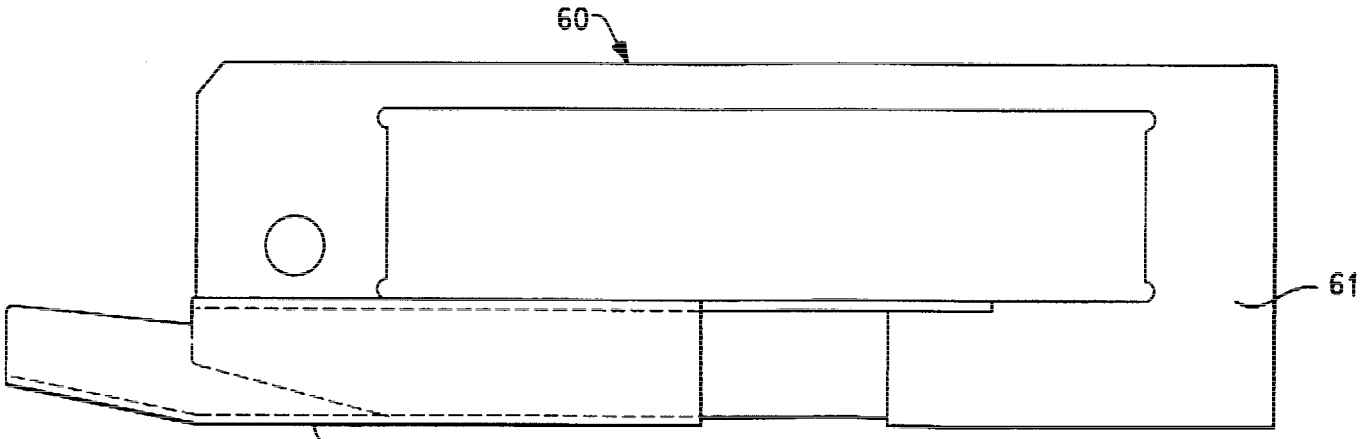
FIG. 6 is a top view of the bolt assembly and cover of FIG. 5.
Figure 7:
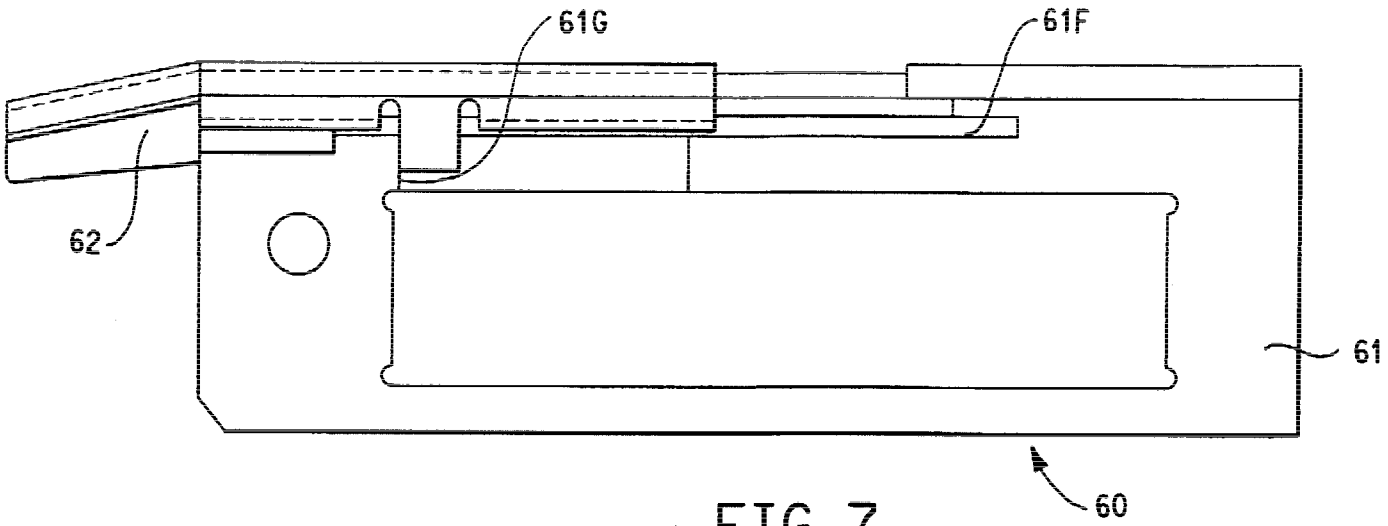
FIG. 7 is a bottom view of the bolt assembly and cover of FIG. 5.
Figure 8:
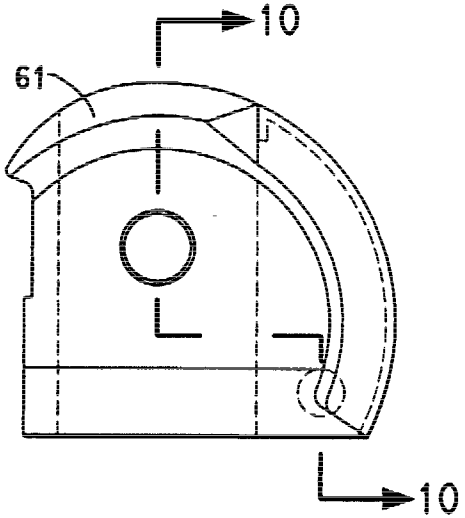
FIG. 8 is a rear view of the bolt assembly and cover of FIG. 5.

In FIGS. 1 and 2, the bolt assembly is in a forward ready to fire position. In this position, the ejection port cover extends rearward of the terminal rear end of the bolt body, as shown more clearly in FIG. 2, and covers the rearward portion of the ejection port, as shown more clearly in FIG. 1. In FIGS. 3 and 4, the bolt assembly is in a rearward position, where the bolt body and ejection port cover are in contact with the rear end of the receiver. In this position, the ejection port cover first contacts the rear of the receiver and is urged forward relative to the bolt body, which subsequently contacts the rear of the receiver, as shown in FIGS. 3 and 4, so that the rearward end of the ejection port cover is flush with the rearward end of the bolt body.

As the bolt assembly moves rearward from the forward ready to fire position, the ejection port cover, extending rearward of the bolt body, comes into contact with the rear of the receiver. The rear of the receiver limits the rearward motion of the ejection port cover, but the rearward motion of the bolt body is not limited until it contacts the rear of the receiver. When both the ejection port cover and bolt body have contacted the rear of the receiver, the ejection port cover has been urged forward, relative to the bolt body, as shown in FIGS. 3 and 4. As the bolt assembly returns to the forward breech closed position, the bolt body moves forward, away from the rear of the receiver, while the ejection port cover is biased rearward with respect to the bolt body, and the ejection port cover returns to the position shown in FIGS. 1 and 2, where it extends rearward of the bolt body to cover the rearward portion of the ejection port.

The longitudinal movement of the ejection port cover is proportionate to the longitudinal movement of the bolt body, the proportion being determined by the relation between the mass of the bolt body, the mass of the ejection port cover, and the strength of the spring. For example, as the bolt assembly is urged rearward to the breech open position, the ejection port cover is also urged rearward, but at an initial rate that is less than the rate of rearward motion of the bolt body. The difference between the motion of the bolt body and the ejection port cover results in the compression of the spring. If the rigidity of the spring is increased, the difference between the initial rate of motion of the ejection port cover and the bolt body will decrease.

In firearms having a bolt assembly comprising a bolt carrier assembly, and wherein the bolt body rotates in the forward breech closed position, the longitudinal movement of the ejection port cover is also proportionate to the longitudinal movement of the bolt carrier assembly, the proportion being determined by the relation between the mass of the bolt carrier assembly, the mass of the ejection port cover, and the strength of the spring. In such firearms, the difference between the motion of the bolt carrier assembly and the ejection port cover results in the compression of the spring.

FIGS. 5 through 14 show various views and segments of a bolt body and ejection port cover of one embodiment of the present bolt assembly. In FIGS. 5 to 14, other components of a typical bolt assembly, such as the firing pin, firing pin spring and extractor have been omitted for clarity. Alternate embodiments of the present invention will be apparent to those skilled in the art, as the configuration of the bolt assembly will depend upon the type of firearm for which it is adapted.

FIGS. 5 to 10 show alternate views of a bolt body 61 and ejection port cover 62 that can be used in the embodiment of the present bolt assembly shown. The bolt body comprises an aperture 61A adapted to retain a spring 61B. The spring biases the ejection port cover rearward with respect to the bolt body, as shown in FIGS. 5 through 10.

Figure 9:
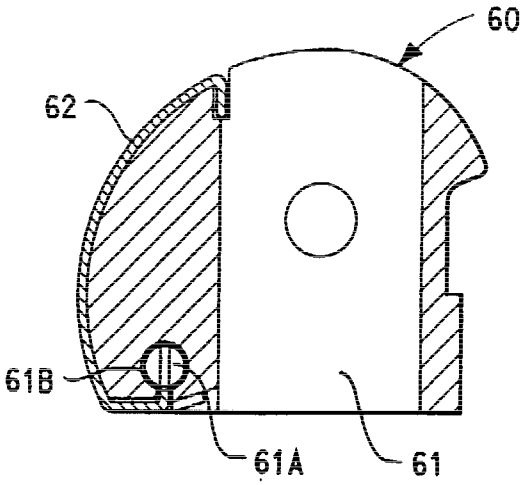
FIG. 9 is a sectional view of the bolt assembly and cover of FIG. 5, take n along line 9—9 of FIG. 5.
Figure 10:
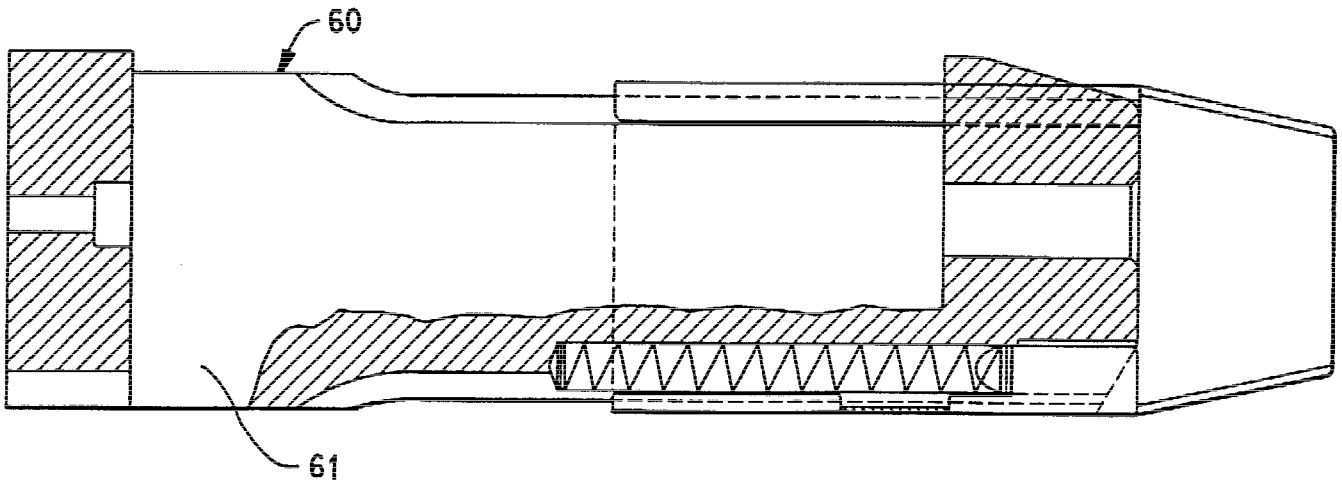
FIG. 10 is a partial sectional view of the bolt assembly and cover of FIG. 5, taken along line 10—10 of FIG. 8.

As shown in FIG. 9, the ejection port cover of the present invention covers less than about 180° of the surface of the bolt body. The ejection port cover should cover enough of the surface of the bolt body so that it can also cover the ejection port. The exact relationship between the ejection port cover and the bolt body will be determined based upon the type of firearm, as well as the dimensions of the ejection port and bolt body, as will be evident to those skilled in the art.

Figure 11:
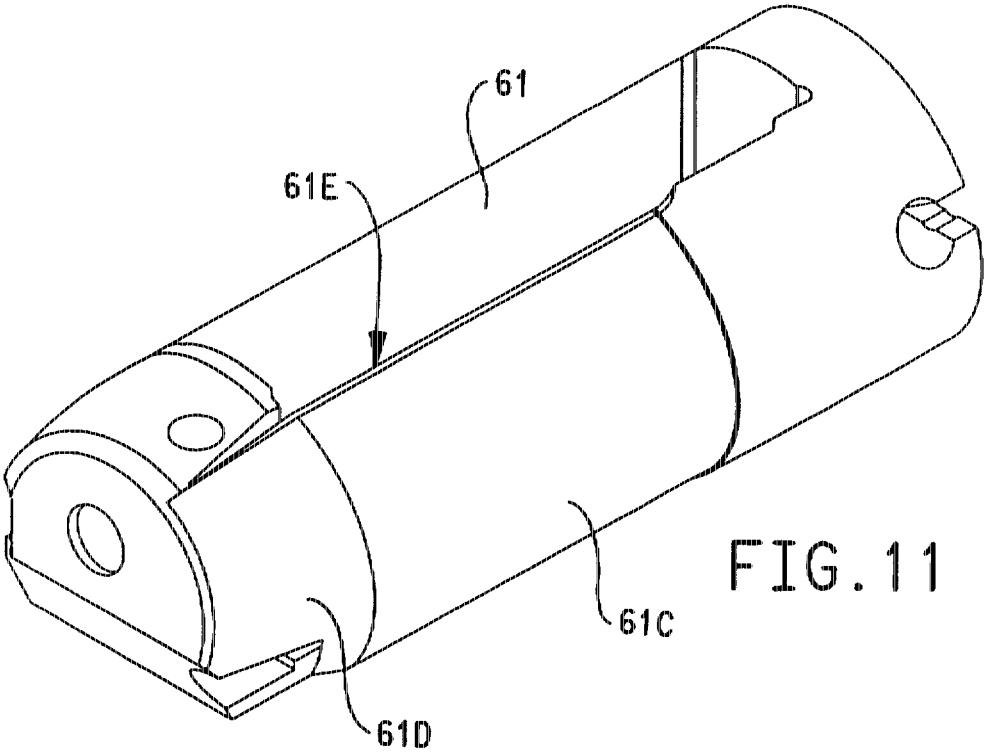
FIG. 11 is an isometric top view of a bolt body of the bolt assembly of the present invention.
Figure 12:
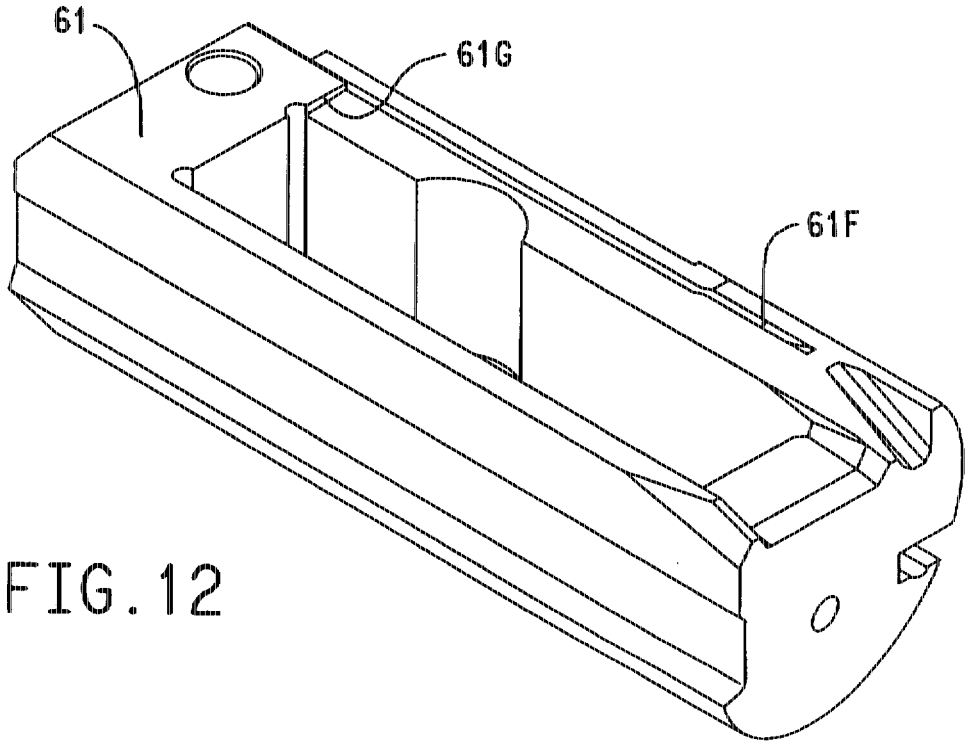
FIG. 12 is an isometric bottom view of a bolt body of the bolt assembly of the present invention.

FIGS. 11 and 12 show only the bolt body of the bolt assembly shown in the previous figures. The bolt body further comprises an ejection port cover bearing surface 61C. The port cover bearing surface further comprises a conical segment 61D at the rear of the bolt body that conforms the rear of the bolt body to the rearward portion of the receiver. For aesthetic and functional reasons, the rearward portion of the receiver slopes downward to its terminal end where the receiver is joined to the stock, and thus the rear of the bolt body should be similarly shaped so that the bolt assembly can slide into the rearward portion of the receiver into its breech open position.

The bolt body further comprises retaining means, adapted to interact with the retaining means of the ejection port cover to operatively connect the bolt body to the cover. In embodiments of the bolt assembly of the present invention that comprise a bolt body of the type shown in FIGS. 11 and 12, the retaining means can comprise an upper retaining slot 61E, a lower retaining slot 61F, and a stop surface 61G. On the top portion of the bolt body, as shown in FIG. 11, the bolt body has an upper retaining slot 61E, while the lower side of the bolt body has a lower retaining slot 61F extending longitudinally along the underside of the bolt body, as shown in FIG. 12. The lower retaining slot is adapted to interact with a complementary component of the retaining means, which in the present embodiment is shown most clearly in FIG. 8 as a lower flange 62F on the ejection port cover. The upper retaining slot is adapted to interact with the upper flange of the cover.

Figure 13:
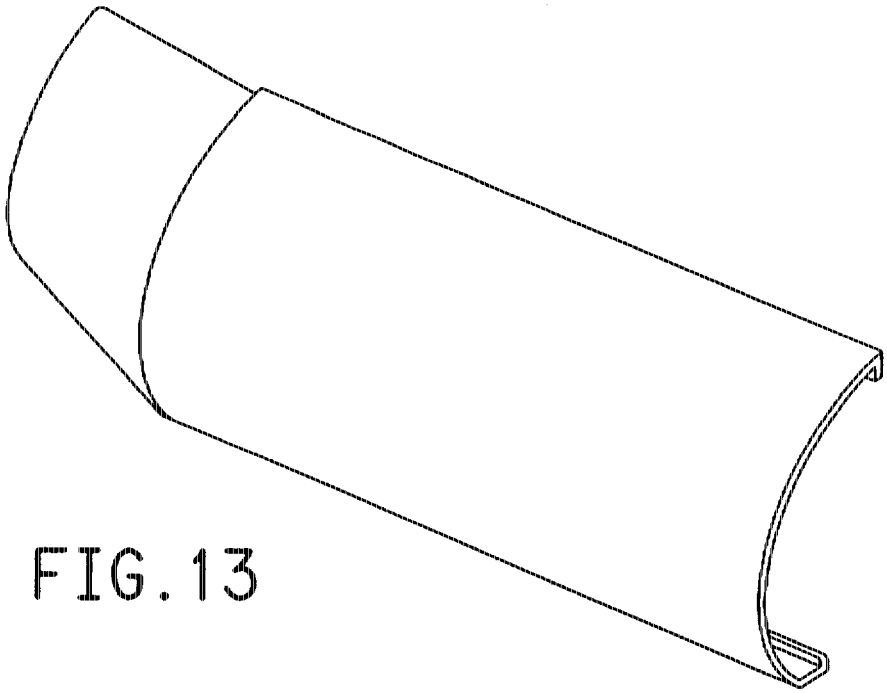
FIG. 13 is an isometric outside end view of an ejection port cover
Figure 14:
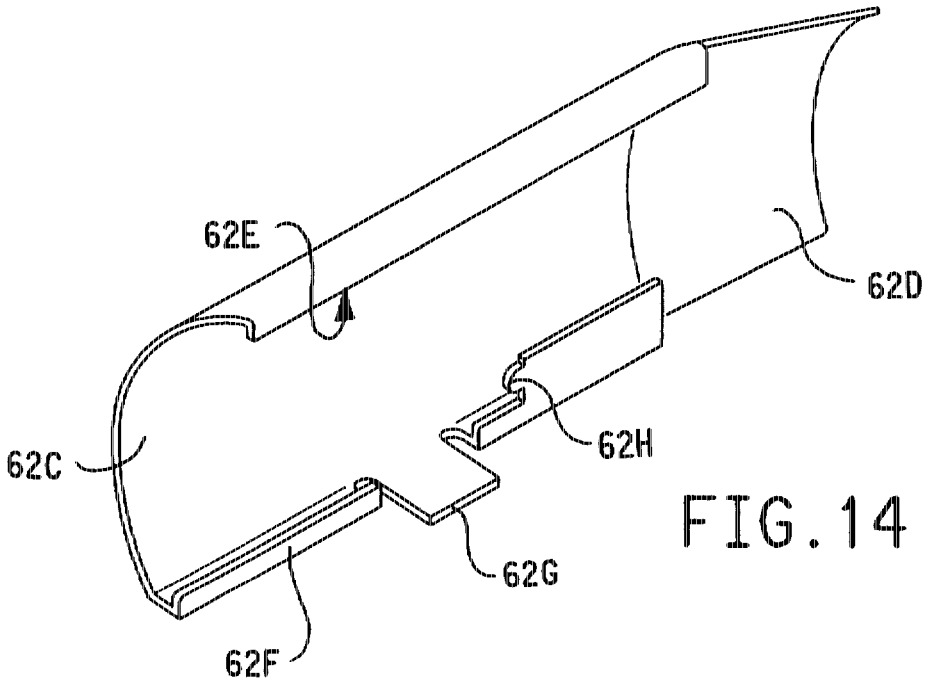
FIG. 14 is an isometric inside end view of an ejection port cover.

FIGS. 13 and 14 show the ejection port cover and its component features, including the retaining tab 62G, upper flange 62E, and lower flange 62F, which are also components of the retaining means that are located on the ejection port cover. In FIGS. 13 and 14, the ejection port cover has a main bearing surface 62C adapted to interact with the main bearing surface 61C of the bolt, a conical rear segment 62D that is also adapted to interact with the conical rear segment 61D of the bearing surface of the bolt body, and a retaining tab. 62G. The retaining tab is adapted to interact with a stop surface on the bolt body to limit the motion of the ejection port cover with respect to the bolt body and thus to keep the bolt body and ejection port from becoming disconnected.

The cover also has an upper flange 62E adapted to interact with the upper retaining slot 61E of the bolt body, and a lower flange 62F adapted to interact with the lower retaining slot 61F to connect the ejection port cover to the bolt body while permitting independent motion of each. Preferably, the forward end of the retaining tab 62G comprises an ejection port cover spring seat 62H. The upper flange and lower flange of the ejection port cover, together with the retaining tab, comprise the retaining means of the embodiment of the ejection port cover shown.

FIG. 15 shows an alternate embodiment of a bolt assembly of the present invention adapted for use in a firearm having a rotating and reciprocating bolt assembly. In such firearms, embodiments of the bolt assembly of the present invention may further comprise a bolt carrier assembly 70. The ejection port cover of the present invention is operatively connected to the bolt carrier assembly, as shown in FIG. 15, to move with the bolt carrier assembly at a rate proportionate to that of the carrier.

I claim:

1. In a firearm having a barrel assembly, a trigger assembly, a receiver having an ejection port, a bolt assembly moveable within the receiver between a forward breech closed position and a rearward breech open position, an improved bolt assembly comprising a bolt body, a firing pin, and an ejection port cover slideably connected to the bolt assembly, the ejection port cover biased rearward with respect to the bolt body to cover at least a rearward portion of the ejection port when the bolt assembly is in a forward breech closed position, the ejection port cover slideably connected to the bolt assembly to move, along a longitudinal axis parallel to the barrel assembly, with the bolt assembly to uncover the ejection port when the bolt assembly is in the rearward breech open position.

2. A firearm of claim 1 wherein the bolt assembly further comprises a spring positioned to bias the ejection port cover rearward.

3. A firearm of claim 1 wherein the ejection port cover covers less than about 180° of the circumference of at least a portion of the bolt body and is of sufficient dimensions to cover the portion of the ejection port not covered by the bolt assembly when the bolt assembly is in the forward breech closed position.

4. A firearm of claim 1 wherein the bolt assembly is positioned within the receiver to slide between forward and rearward positions.

5. A firearm of claim 1 further comprising a bolt stop at the rear of the receiver positioned to limit the rearward movement of the bolt assembly by contacting the ejection port cover and then the bolt body as the bolt assembly moves from the forward position to the rearward position.

6. A firearm of claim 1 wherein the bolt body further comprises ejection port cover retaining means.

7. A firearm of claim 6 where the retaining means comprise at least one slot and at least one mating surface adapted to interact with at least one corresponding tab and at least one corresponding mating surface on the ejection port cover.

8. A firearm of claim 2 wherein the bolt body further comprises a hole formed therein to retain the spring.

9. A firearm of claim 2 wherein the ejection port cover further comprises a spring seat.

10. A firearm of claim 1 wherein the bolt body further comprises a forward restraining means at a forward end thereof, and a rearward restraining means at a rearward end thereof, the forward restraining means positioned to limit the forward longitudinal movement of the ejection port cover, and the rearward restraining means positioned to limit the rearward longitudinal movement of the ejection port cover.

11. A firearm of claim 1 wherein the bolt assembly further comprises a bolt carrier assembly.

12. A firearm of claim 11 wherein the bolt assembly is positioned within the receiver to rotate in the forward breech closed position.

13. In a firearm having a barrel assembly, a trigger assembly, a receiver having an ejection port, a bolt assembly moveable within the receiver between a forward breech closed position and a rearward breech open position, an improved bolt assembly comprising a bolt body, a firing pin, a bolt carrier assembly, and an ejection port cover biased rearward with respect to the bolt carrier assembly to cover at least a rearward portion of the ejection port when the bolt carrier assembly and bolt body are in a forward breech closed position, the ejection port cover operatively connected to the bolt carrier assembly to move, along a longitudinal axis parallel to the barrel assembly, with the bolt carrier assembly to uncover the ejection port when the bolt carrier assembly and bolt body are in a rearward breech open position.

14. A firearm of claim 13 wherein the bolt assembly is positioned within the receiver to rotate in the forward breech closed position.

* * * * *